US005156109A

United States Patent [19]

Husain

[11] Patent Number: 5,156,109

[45] Date of Patent: Oct. 20, 1992

[54] SYSTEM TO REDUCE SPILLAGE OF OIL DUE TO RUPTURE OF SHIP'S TANK

[76] Inventor: Mo Husain, 908 Stratford Ct., Del Mar, Calif. 92014

[21] Appl. No.: 377,886

[22] Filed: Jul. 10, 1989

[51] Int. Cl.[5] ..... B63B 25/08

[52] U.S. Cl. ..... 114/74 R; 114/72

[58] Field of Search ..... 114/72, 73, 74 R, 74 A, 114/227, 229, 228; 220/1 B, 5 A, 1 V, 85 S, 85 VR, 85 VS, 900

[56] References Cited

U.S. PATENT DOCUMENTS

| | | | |
|---|---|---|---|
| 4,114,552 | 9/1978 | Ross et al. | 114/227 |
| 4,161,155 | 7/1979 | Cloutier | 114/229 |
| 4,273,598 | 6/1981 | Bowditch | 114/227 X |
| 4,446,804 | 5/1984 | Kristiansen et al. | 114/74 R |
| 4,519,856 | 5/1985 | Lazzara | 114/227 |

FOREIGN PATENT DOCUMENTS

| | | | |
|---|---|---|---|
| 2031905 | 1/1971 | Fed. Rep. of Germany | 114/74 R |

OTHER PUBLICATIONS

Spill-Proof Oil Tankers?, a publication "Marine Journal" Sep. 1989.

*Primary Examiner*—Ed Swinehart

*Attorney, Agent, or Firm*—William C. Fuess

[57] ABSTRACT

A system to reduce outflow of liquid such as oil due to the rupture of a ship's tank by means of creating and continuing to maintain a partial vacuum in the affected tank or tanks. The system generates a partial vacuum below the atmospheric pressure in the ullage space of the tank(s) and maintains the vacuum to precisely balance the forces acting on the contents of the tank. If the rupture is below the water line then, due to surface tension dynamics resulting in a stratified flow, water will tend to force itself through the lower part of the rupture and force the oil upward and pump out oil over the water until the water level reaches the top part of the rupture. When the water level reaches the top part of the rupture, an equilibrium condition is established and precisely maintained by the partial vacuum condition created by the system. The stratifield flow is stopped by a non-structural barrier placed over the rupture so as to separate the molecules of water thereby, oil and reducing surface tension energy dynamics between two liquids of dissimilar viscosity. If the rupture, such as a hull crack, is above the waterline then a flexible barrier is placed over the rupture to augment the equilibrium condition to prevent the flow of the oil through the rupture.

28 Claims, 3 Drawing Sheets

SYSTEM TO REDUCE SPILLAGE OF OIL DUE TO RUPTURE OF SHIP'S TANK

BACKGROUND OF THE INVENTION

This invention relates to prevention of oil spillage due to accidental rupture of a tank or tanks of a vessel. With the advent of supertankers, a single incident can cause significant damage to environments and disrupt ecological balance as well as cause substantial economic loss. The recent accident of EXXON VALDEZ is perhaps the worst oil spillage disaster in U.S. history and leaked about 240,000 barrels, i.e., over 10 million gallons of oil. The economic and environmental damage is estimated to have been over one billion dollars. Three weeks after the EXXON VALDEZ accident an Indian tanker spilled about a million gallons of oil in the vicinity of Saudi Arabia. Another example of recent supertanker accident is the case of the Stuyvesant, whose hull cracked from battling the heavy seas with a discharge of 600,000 gallons.

Previous efforts to control damage have been principally limited to 'containment and dispersement' of the spilled oil from the ruptured tanker. Although some emphasis has been made on naval architectural solutions to limit the damage from oil spills—such as by making a double bottom, by employing a compartmented design, and by structural strengthening to prevent cracking of the hull limited resources have been directed to prevent the oil spillage once the rupture occurs. This invention addresses the need to prevent the oil from spilling from a ruptured tank of a vessel.

SUMMARY OF THE INVENTION

The principle object of the invention is to provide an economical and low cost system to prevent liquids such as oil from spilling once a rupture occurs in the tank or tanks of a vessel carrying oil. The system can be retrofitted to existing vessels.

Another object of the invention is to contain liquids such as oil in the already ruptured tanks of vessels for time periods sufficient to permit other undamaged vessels to transfer the oil from the ruptured tanks to the tanks of the undamaged vessel or the use of any means to remove the oil from the damaged vessel.

Another object of this invention is to eliminate and/or minimize the environmental damage from a liquid spillage such as oil.

A further object of this invention to eliminate or minimize the economic damage from spillage of a liquid such as oil.

It is also the object of this invention is to eliminate and/or minimize the cost of cleanup after an oil spillage.

Still another object of this invention is to eliminate the need for expensive modification to the hull of a vessel that might be required to reduce the spillage of a liquid such as oil.

This and other objects of the invention are achieved by means of a system creating a partial vacuum in the ruptured tank or tanks by a device such as a pump, and maintaining a precise balance of forces acting on the contents of the tank taking into consideration surface tension dynamics and stratified flow. The device or pumps are connected by ducts and controlled by devices such as valves, and computer such as an IBM 386. If necessary, the duct entry point in the tank is passed through an air chamber. The determination of which of the tank or tanks are ruptured are made by sensors such as tank level indicator (TLI) sensors linked to the computer, or by physical inspection. If the rupture is below the waterline then, due to surface tension dynamics and resultant stratified flow, water will pour in the tank through the rupture in spite of the partial vacuum unless a barrier such as a vertical flexible membrane such as turpaulin is placed over the vertical extent of the rupture so as to separate the two dissimilar viscous surfaces. In the absence of the vertical barrier, water from the outside will enter the tank through the lower part of the rupture and will lift the oil mass and force the oil out through the upper part of the rupture until the water level reaches the top part of the vertical extent of the rupture. However, by maintaining a precise balance of forces acting on the contents of tank by introducing a partial vacuum below the atmospheric pressure, an equilibrium condition can be reached and no further outflow of oil will occur. Statistically, most of the accidental ruptures of tanker vessel are near the bottom and therefore even without the barrier separating the two liquids of dissimilar viscosity, maximum reduction of spillage of oil from accidentally ruptured tanks is achieved with the system of the invention.

Three subscale models have been successfully tested with oil inside the tank and water outside.

BRIEF DESCRIPTION OF THE DRAWING

For a more complete understanding of the invention and for further objects and values thereof, references are now made to the accompanying drawings, referred to as Figures, which includes a cross-sectional diagram of hypothetical rupture locations, a cross-sectional diagram of a hypothetical rupture location and stratified flow of oil, and a schematic arrangement of the system in an oil tanker, and a diagram depicting Equilibrium of Forces, and a plot of Partial Suction Pressure Vs. Height of Hole below Waterline.

DESCRIPTION OF THE PREFERRED EMBODIMENT OF THE INVENTION

Figure 1:
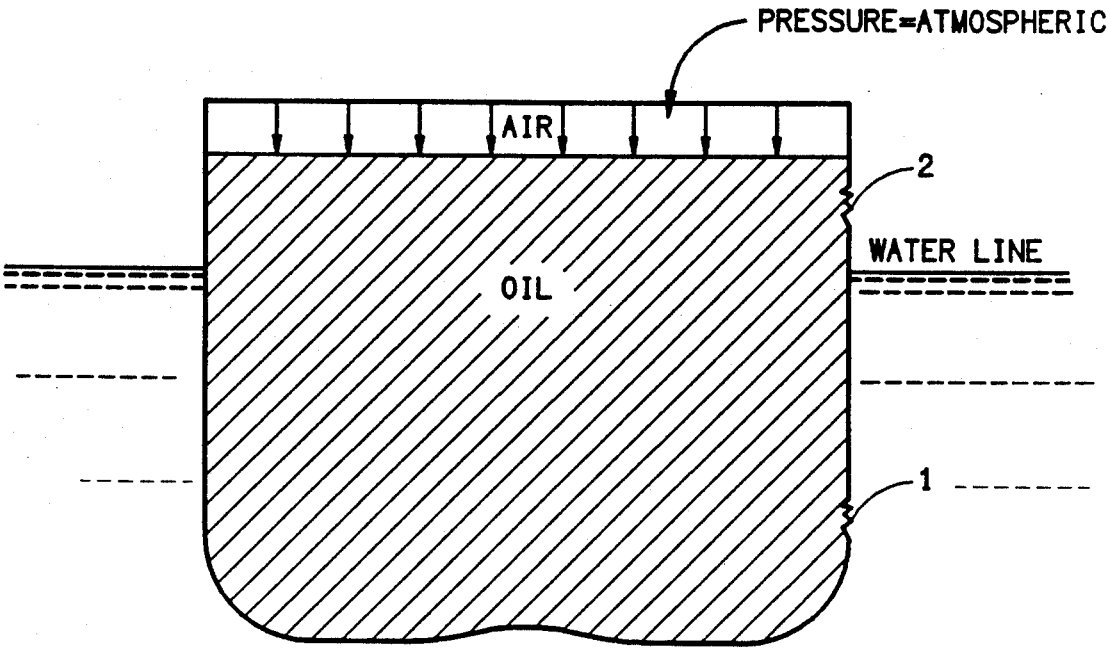
FIG. 1 (PRIOR ART)
FIG. 1 is a cross-sectional Diagram of Hypothetical Rupture Locations.
Figure 3A:
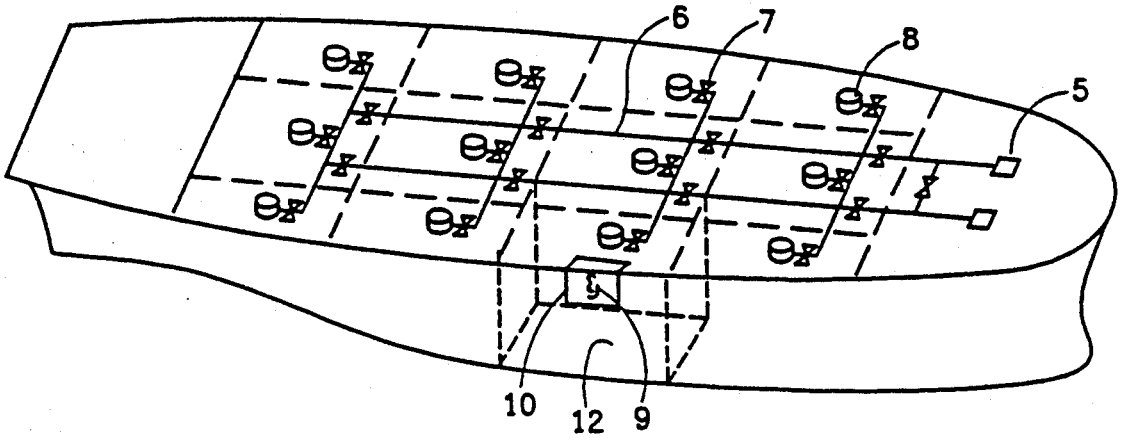
FIGS. 3*a* and 3*b* show a Schematic Arrangement of the System in an Oil Tanker.
Figure 3B:
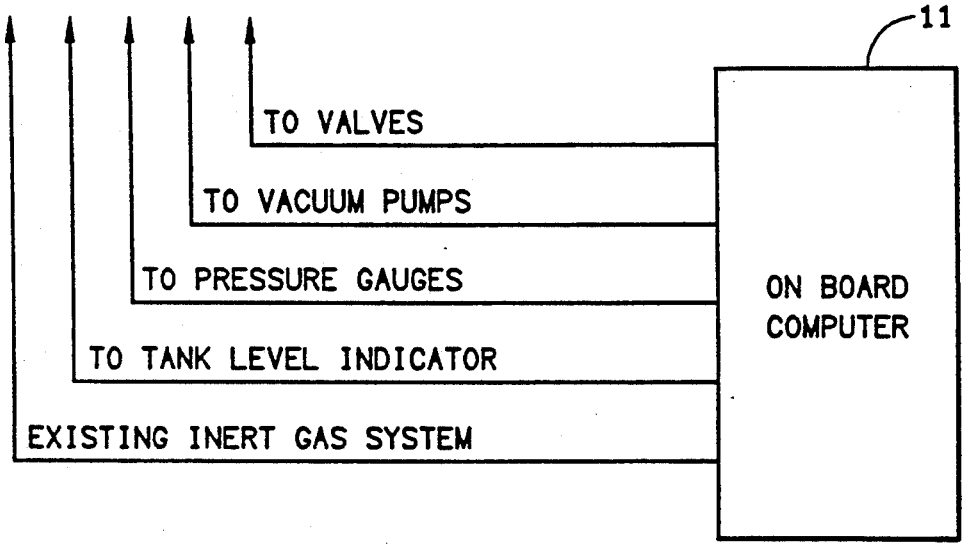

The present invention provides a method for preventing, reducing, or minimizing the oil flow from a ruptured tank or tanks of a vessel, ocean based platforms and/or land-based tanks. The system is comprised of pumping devices such as vacuum pumps 5, ducts 6, gating devices such as valves 7, electronic sensors, computer 11 and a non-structural barrier, such as a a flexible barrier similar to tarpaulin 10 or a rigid barrier or a chemical barrier. The pumping devices such as vacuum pumps 5 are connected to the tank 12 or tanks by ducts 6. The pumping devices such as vacuum pump 5 or pumps are controlled by a computer 11 having a manual override in case of failure of the computer system. The pumping devices such as vacuum pumps 5 and devices such as valves 7 can also be totally manually controlled. In case of either a below-waterline rupture 2 (FIG. 1) or a rupture 9 (FIG. 3*a*) above the ship's waterline or in a land based tanks where the rupture is exposed to air, a flexible barrier similar to a tarpaulin 10 is place over the rupture.

The partial vacuum condition in the ruptured tanks will be maintained continuously by pumping out air from the ruptured tanks by means of devices such as vacuum pumps 5 which connect to the tank or tanks by ducting 6. The pumping is controlled by means of devices such as valves and by a computer. The magnitude of outflow of air required to maintain the partial vacuum condition is dependent on the waterline outside tanks, the height of oil inside the tank, vertical location of the rupture relative to the waterline outside the hull, size of the rupture or hole and air leakage through the seams rivets, and non-tight hatches, or openings; of the surface tension energy between two dissimilar viscous fluids is also included. The entry point of the duct in the tank must be free of oil and only air space is allowed at the entrance of the duct into the tank. If operational requirement dictates the tank level to be completely full then an air chamber 8 is placed on the top of the tank for the entry point of the duct.

Figure 2:
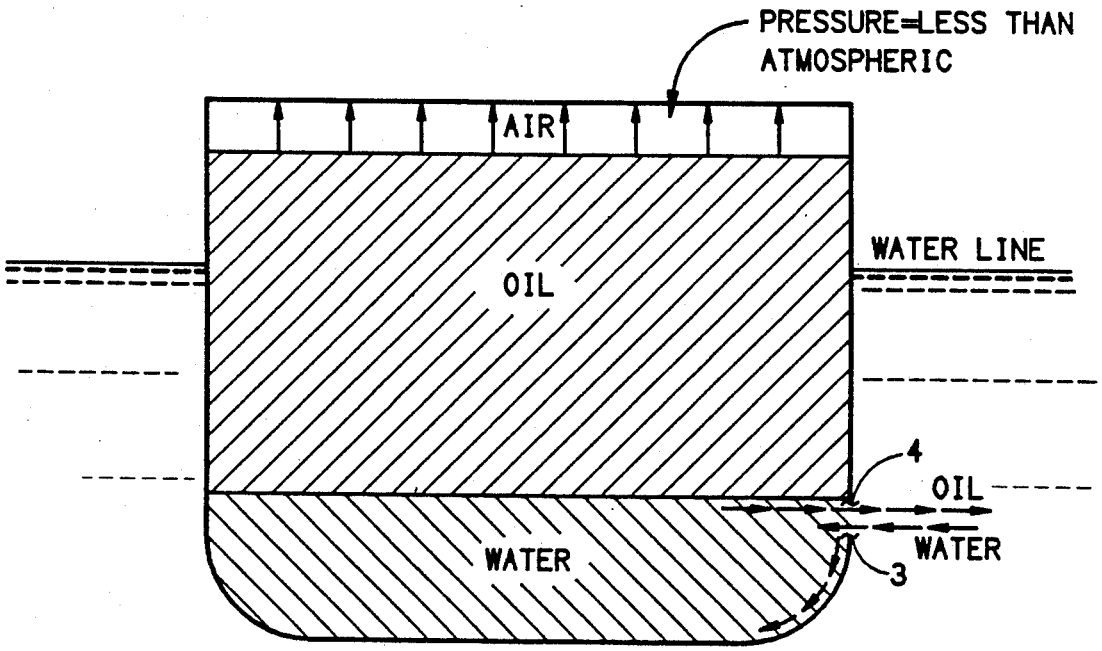
FIG. 2 (PRIOR ART)
FIG. 2 is a cross-sectional diagram of Hypothetical Rupture location and Stratified Flow.

In case of rupture below the waterline, and immediately after the rupture occurs, determination of which tank(s) are ruptured are made by means of sensors such as tank level indicator (TLI) sensors in the tank or by physical inspection. Sensors are linked to the computer 11. After the determination of which tanks are ruptured, vacuum pump 5 or pumps are activated to create a partial vacuum below the atmospheric pressure level in the ruptured tanks to create an equlibrium condition. However, due to surface tension energy between two dissimilar viscous fluids and the resultant stratified flow, water will flow into the tank through the lower part 3 (FIG. 2) of the rupture in spite of the partial vacuum unless a rigid, or a flexible barrier such as tarpaulin 10 (FIG. 3*a*) or chemical barrier is placed on the location of the rupture so as to separate the two dissimilar viscous surfaces. In the absence of a vertical barrier water from outside the tank will enter through the lower part 3 (FIG. 2) of the rupture 4 and lift the oil mass and pump out oil over the water untill the water level reaches the top part of the rupture 4 (FIG. 2). However, equilibrium condition will be restored by the system by balancing all the forces acting on the liquid contents of the tank and the flow of oil from the tank is stopped. Because oil is lighter than water, the water inside the tank will augment the equilibrium condition.

In case of rupture 2 above the waterline (FIG. 1) or a rupture 9 (FIG. 3*a*) such as hull cracks, a flexible barrier such as tarpaulin 10 will be placed over the rupture. After the event of rupture occurs, a flexible barrier is placed over the rupture, vacuum system or devices or pumps 5 are activated to create partial vacuum in the ruptured tank or tanks, and the partial vacuum is maintained by means of devices such as a vacuum pump 5 and devices such as valves 7 which are all controlled and monitored by computer similar to an IBM 386. After the equilibrium condition is reached by means of creating a partial vacuum below the atmospheric pressure level, oil will virtually stop flowing out of the tank through the rupture.

For flow stability in a ruptured tank the air pressure of the tank ullage must be kept below atmospheric pressure. Typically, a few psi reduction is adequate. The mechanical system to implement this consists of pumps, sensors, and control valves. The pumping device can be either a mechanical pump (Roots Blower) or a static steam ejector. The duct system can (Roots Blower) or a static steam ejector. The duct system can consist of a common duct headers leading to a centrally located pump. The pump optimization of the pump/ducting system will depend on many factors such as upon a requirement for the suction pressure to be maintained whenever the tank is filled or only during ship's operations. The latter requirement may have the least impact in the ship configuration for it may be possible to use the vacuum pumps of the main steam turbine propulsion system otherwise used to maintain condensate vacuum pressure or the steam of the main boilers to activate a series of steam ejectors in order to provide the required suction pressure. A further consideration is the use of two (2) sizes of pumps, the larger one (roughing) to provide the vertical pump-down and a smaller pump to maintain the desired vacuum pressure. Typically, a Roots Blower requires 20 kw of power input to evacuate 2000 liters/sec of air.

In all cases, a data bus for the transmission of control data to a central computer may be a requirement. Such data transmission is typically simple and trouble free because of the low data rate and because the necessary software can be housed into the logic chips. The choice of electric power may be obtained by tapping into the ship's electric power system.

Figure 4:
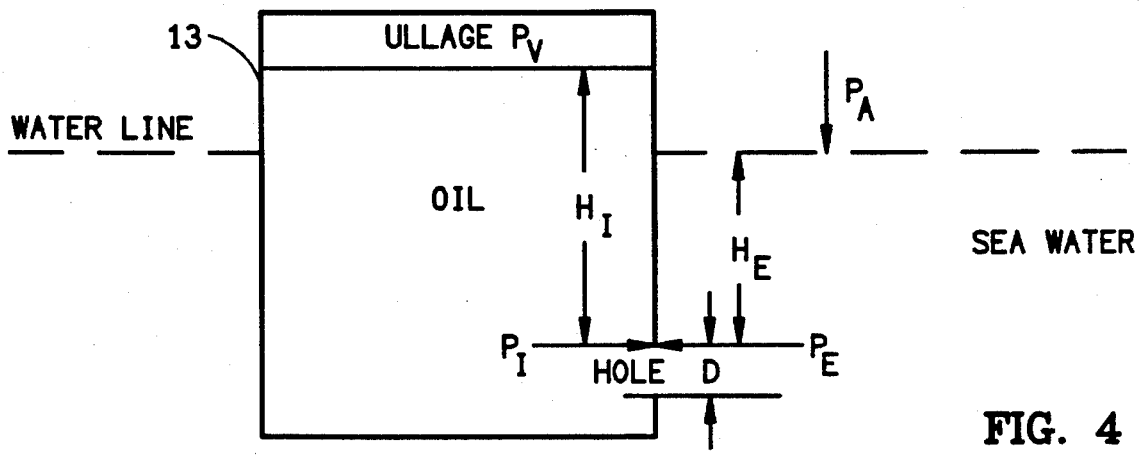
FIG. 4 is a Diagram depicting Equilibrium of Forces.

The equilibrium of forces obtained without the consideration of surface tension dynamics are shown in 13, FIG. 4.

The tank of oil floating in the ocean as depicted having a partial vacuum P in the ullage volume suffers a rupture below the water line at a depth of h feet to the top of rupture. Simple forces exist up to the top of rupture. It can be shown that the external and vertical pressure can be made equal by adjusting the partial vacuum P in the ullage volume.

External Pressure ($P_E$) = atmospheric pressure + hydrostatic pressure $P_A + h_e\rho_w$.

Internal Pressure ($P_1$) = hydrostatic oil pressure + partial vacum pressure $= h_1\rho_o + P_v$ $$P_E - P_1 = P_A + h_e\rho_w - (h_1\rho_o + P_v)$$

where
$h$ = head in feet
$\rho_w$ = water density in lb/ft$^3$
$\rho_o$ = oil density in lb/ft$^5$
$P_v$ = pressure in lb/ft$^2$ For forces & balance $P_E - P_1 = 0$ and
$P_v = P_A + h_e\rho_w - h_1\rho_o$ If we assume some typical values where
$h_e = 30$ ft, $h_1 = 40$ ft.
$\rho_w = 64$ lb/ft$^3$, $\rho_o = 57$ lb/ft$^3$
$P_A = 14.7$ psi The required $P_v$ for stability is $$P_v = 14.7 \times 144 + 30 \times 64 - 40 \times 57$$
$$= 1757 \text{ psf } (12.2 \text{ psi})$$

Figure 5:
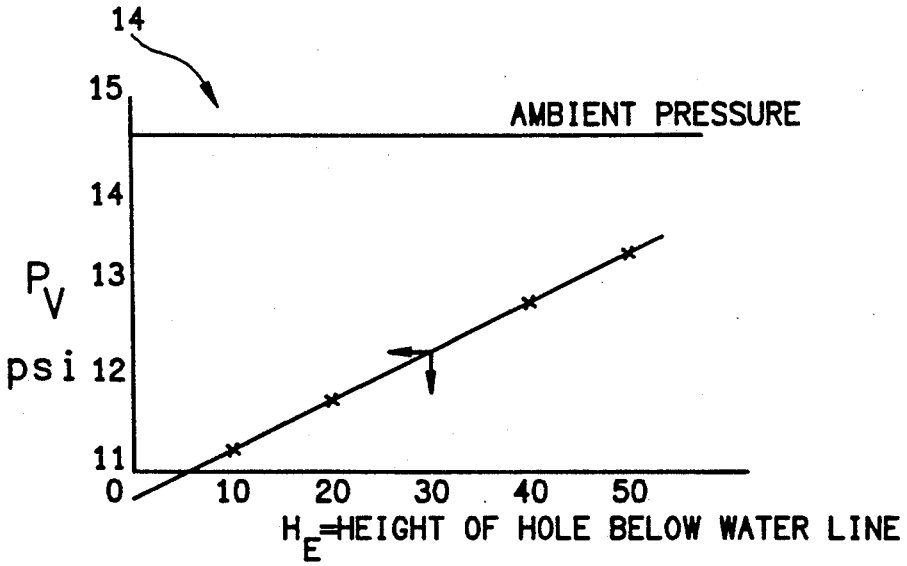
FIG. 5 is a Plot of Partial Suction Pressure Vs Height of hole below Waterline.

A moderate reduction in pressure (2.5 psi drop) is required to balance forces and ensure that the oil above the rupture is static and does not flow out. A further expansion of these results is depicted in 14, FIG. 5. The partial suction pressure required to balance the forces is plotted as the height of ruptured hole below the waterline varies. A few psi drop is all that are required and there are no need for high vacuum pumping. A balance of forces in the vicinity of the ruptured hole may be obtained in the presence of surface tension dynamics. The simple mechanism that balances forces illustrated above, becomes far more complicated around the ruptured hole. Non-linear surface tension forces exist across the dissimiar fluids oil/water. These surface tension forces result in a stratified flow causing the water to displace the oil below the ruptured hole. If the relatively small volume of oil displaced as a result is to be totally prevented a non-structural barrier must be placed or chemical barrier between the fluids and across the ruptured hole. This non-structural barrier separates the molecules of the two dissimilar viscous liquids, and thus prevents a stratified flow.

Three subscale model has been successfully tested with oil inside the tank and water outside.

While the preferred embodiment of the invention has been disclosed, modifications can be made to it, and other embodiments of the invention can be devised, without departing from the spirit of the invention and the scope of the appended claims.

What is claimed is:

1. A system to reduce spillage of oil due to a rupture of ship's tank containing oil, the system comprising:

vacuum means controllable for creating a partial vacuum, less than atmospheric pressure, of controlled magnitude in an ullage space of the tank; and control means for dynamically controlling the vacuum means so as to maintain a balance of internal and external forces acting on the oil contents of the tank at the location of the rupture regardless that such forces should vary.

2. The system claimed in claim 1 wherein said vacuum means comprises:

a pump.

3. The system claimed in claim 2 further comprising:

a duct for connecting the pump to the ullage space of the tank.

4. The system claimed in claim 3 further comprising:

an enclosure for protecting an entry point of the duct into the tank from oil intrusion.

5. The system claimed in claim 1 wherein the vacuum means comprises:

a control valve for controlling a flow of gas from the ullage space of the tank.

6. The system claimed in claim 5 wherein the control valves are actuated by means of motors.

7. The system claimed in claim 1 wherein the control means comprises:

means for monitoring the magnitude of the partial vacuum; and a computer that controls the vacuum means responsive to the monitored magnitude.

8. The system claimed in claim 1 further comprising:

non-structural barrier means positionable and positioned to cover a rupture of the ship's tank occurring below a waterline of the ship in order to reduce surface tension dynamics and stratified flow between the oil contents of the ship's tank and water surrounding the ship.

9. The system claimed in claim 1 further comprising:

non-structural barrier means positionable and positioned to cover a rupture of the ship's tank occurring above a waterline of the ship in order to augment the balance of forces acting on the oil contents of the ruptured tank as maintained by the vacuum means controlled by the control means.

10. The system claimed in claim 1 for use on a ship having a plurality of tanks containing oil wherein the control means comprises:

means for determining which tank of the plurality of tanks of the ship are ruptured; and a computer, on board the ship, responsive to the means for determining for controlling the vacuum means.

11. The system claimed in claim 5 further comprising:

manual means for actuating the control valve.

12. The system claimed in claim 9 wherein the non-structural barrier means comprises:

a flexible barrier.

13. The system claimed in claim 9 wherein the non-structural barrier means comprises:

a rigid barrier.

14. The system claimed in claim 9 wherein the non-structural barrier means comprises:

a chemical barrier.

15. The system claimed in claim 10 wherein the non-structural barrier means comprises:

a flexible barrier.

16. The system claimed in claim 10 wherein the non-structural barrier means comprises:

a rigid barrier.

17. A system to reduce spillage of oil due to a rupture of a tank of a vessel, which tank contains oil, the system comprising:

vacuum means controllable for creating a controllable pressure, less than atmospheric pressure, in an ullage space of the vessel's tank containing oil; and control means for dynamically controlling the vacuum means so as to maintain a balance of forces acting on the oil contents of the tank at the location of the rupture regardless that such forces should vary over time upon the occasion of the rupture.

18. The system according to claim 3 wherein the vacuum means comprises:

gas pumping means controllable and controlled for creating the controllable pressure less than the atmospheric pressure commencing at a time prior to a voyage of the vessel.

19. The system according to claim 3 wherein the vacuum means comprises:

gas pumping means controllable and controlled for creating and maintaining the controlled pressure that is less than the atmospheric pressure substantially continuously during a voyage of the vessel.

20. A system to reduce spillage of oil due to a rupture of a tank of a vessel, which tank contains oil, the system comprising:

vacuum means controllable for creating a controllable pressure, less than atmospheric pressure, in the ullage space of the vessel's tank containing oil; and control means for dynamically controlling the vacuum means so as to maintain a balance of forces acting on the oil contents of the tank at the location of the rupture regardless that such forces should vary dependent upon such location of the rupture.

21. The system according to claim 20 wherein the vacuum means comprises:

gas pumping means controllable and controlled for creating the controllable pressure less than the atmospheric pressure commencing at a time prior to a voyage of the vessel.

22. The system according to claim 20 wherein the vacuum means comprises:

gas pumping means controllable and controlled for creating and maintaining the controlled pressure that is less than the atmospheric pressure substantially continuously during a voyage of the vessel.

23. A method of managing the gas pressures within an ullage space of a ship's tank containing oil, the method comprising:

determining substantially continuously during a voyage of a ship the pressure forces acting upon the oil contents of the ship's tank, which pressure forces are subject to change if the tank incurs a rupture; and maintaining substantially continuously dynamically during the voyage of the ship a gas pressure within the ullage space to be constantly of less than atmospheric pressure, and to be of such a magnitude less so that internal and external pressure forces acting upon the oil contents of the ship's tank are constantly substantially in balance regardless that these internal and external pressure forces should change, either or both, upon any occasion of a rupture of the tank.

24. The method according to claim 23 wherein the determining comprises:

constantly and dynamically calculating the magnitude of an ullage space gas pressure $P_v$ which, when added to an instantaneous hydrostatic pressure of the oil at a height $h_i$ above any rupture to the tank, will equal an external pressure $P_E$ occurring at the highest point of a rupture to the tank; and wherein the maintaining comprises:

constantly and dynamically pumping gas from the ullage space of the ship's tank so as to substantially continuously maintain the calculated ullage space gas pressure $P_v$ therein;

wherein because an internal pressure $P_I$ within the tank, which internal pressure $P_I$ equals $P_V$ plus the hydrostatic pressure of the oil, is dynamically maintained equal to said external pressure $P_E$, any oil out-flow, or spillage, is substantially prevented from points above said highest point of a rupture.

25. The method according to claim 24 which, upon the occurrence of any rupture to the ship's tank which rupture is below the ship's waterline, further comprises:

placing a non-structural barrier at the rupture to the tank that is below the ship's waterline, and between the oil that is within the tank and the surrounding water, so as to aid, by avoidance of stratified flow, any oil out-flow, or spillage, from points below the highest point of a rupture.

26. A system for dynamically managing the gas pressure within an ullage space of a ship's tank containing fluid, the spillage of which fluid from the tank upon any rupture to the tank is desired, insofar as is possible, to be avoided, the system comprising:

means for continuously calculating during a voyage of the ship the magnitude of an ullage space gas pressure $P_V$ which, when added to an instantaneous hydrostatic pressure of the oil at a height $h_i$ above any rupture to the tank will equal an external pressure $P_E$ occurring at the highest point of said any rupture to the tank;

means, continuously operative during the voyage of the ship, for pumping gas from the ullage space of the ship's tank as required so as to substantially continuously maintain the calculated ullage space gas pressure $P_v$ therein;

wherein the pressure forces acting on the fluid contents of the tank at the location of any rupture are maintained in balance regardless that such forces should vary.

27. A system for controlling the spillage of fluid from a ship's tank containing fluid, which fluid has a different viscosity than water, through a rupture to the tank which rupture is occuring below a waterline of the ship, the system comprising:

vacuum means for maintaining a gas pressure within an ullage space of the ship's tank to be less than atmospheric pressure, and to be of such a magnitude less so that internal and external pressure forces acting upon the fluid contents of the ship's tank are substantially in balance at the location of the rupture to the tank; and non-structural barrier means, having insubstantial strength to patch the rupture, locatable at the site of the rupture and between the fluid and the water for the purpose of physically separating the fluid that is most substantially within the ship's tank and on one side of the rupture from the water of differing viscosity that is most substantially outside the ship and on the other side of the rupture;

wherein location of the non-structural barrier means at the rupture site helps to prevent, in combination with the vacuum means, such a stratified flow through the rupture, and between the fluid and the water which are of differing viscosities, as would otherwise occur.

28. A method of controlling the spillage of fluid from a ship's tank containing fluid, which fluid has a different viscosity than water, through a rupture to the tank below a waterline of the ship, the method comprising:

maintaining a gas pressure within an ullage space of the ship's tank to be less than atmospheric pressure, and to be of such a magnitude less so that internal and external pressure forces acting upon the fluid contents of the ship's tank are substantially in balance at the location of the rupture to the tank; and locating a non-structural barrier means, having insubstantial strength to patch the rupture, at the site of the rupture and between the fluid and the water for the purpose of physically separating the fluid that is most substantially within the ship's tank and on one side of the rupture from the water of differing viscosity that is most substantially outside the ship and on the other side of the rupture;

wherein the locating of the non-structural barrier means at the rupture site helps to prevent, in combination with the maintaining of the gas pressure, such a stratified flow through the rupture, and between the fluid and the water which are of differing viscosities, as would otherwise occur.

* * * * *